US005249562A

United States Patent [19]

Klenk et al.

[11] Patent Number: 5,249,562

[45] Date of Patent: Oct. 5, 1993

[54] METHOD FOR PROTECTING A CATALYTIC CONVERTER

[75] Inventors: Martin Klenk, Backnang; Winfried Moser, Ludwigsburg; Anton Kantschar, Eberdingen-Hochdorf, all of Fed. Rep. of Germany

[73] Assignee: Robert Bosch GmbH, Stuttgart, Fed. Rep. of Germany

[21] Appl. No.: 854,628

[22] PCT Filed: Jan. 17, 1991

[86] PCT No.: PCT/DE91/00031

§ 371 Date: Jul. 6, 1992

§ 102(e) Date: Jul. 6, 1992

[87] PCT Pub. No.: WO91/11601

PCT Pub. Date: Aug. 8, 1991

[30] Foreign Application Priority Data

Jan. 26, 1990 [DE] Fed. Rep. of Germany ..... 4002207

[51] Int. Cl.[5] ..... F02D 41/14; F02D 41/22

[52] U.S. Cl. ..... 123/679; 123/481

[58] Field of Search ..... 123/198 DB, 481, 679, 123/690

[56] References Cited

U.S. PATENT DOCUMENTS 3,983,754 10/1976 Deguchi et al. ..... 73/346
4,951,773 8/1990 Poirier et al. ..... 123/481 X
4,979,481 12/1990 Shimomura et al. ..... 123/481

FOREIGN PATENT DOCUMENTS 59-208134 11/1984 Japan .
59-226245 12/1984 Japan .
62-270247 5/1989 Japan .

*Primary Examiner*—Tony M. Argenbright
*Attorney, Agent, or Firm*—Walter Ottesen

[57] ABSTRACT

In a method for protecting a catalytic converter from overheating, a conventional misfire recognition method is used to determine whether misfires are occurring in a cylinder. If this is the case, an attempt is made to interrupt the fuel supply to the affected cylinder. If this succeeds, the remaining cylinders are supplied with a lean mixture. If it does not succeed, all the cylinders are operated with a rich mixture. The lean setting of the mixture in the case of interrupted fuel supply to the affected cylinder has the effect that after the combustions in the cylinders, no further fuel reaches the catalytic converter which could combust in the catalytic converter with the oxygen induced by the affected cylinder.

3 Claims, 1 Drawing Sheet

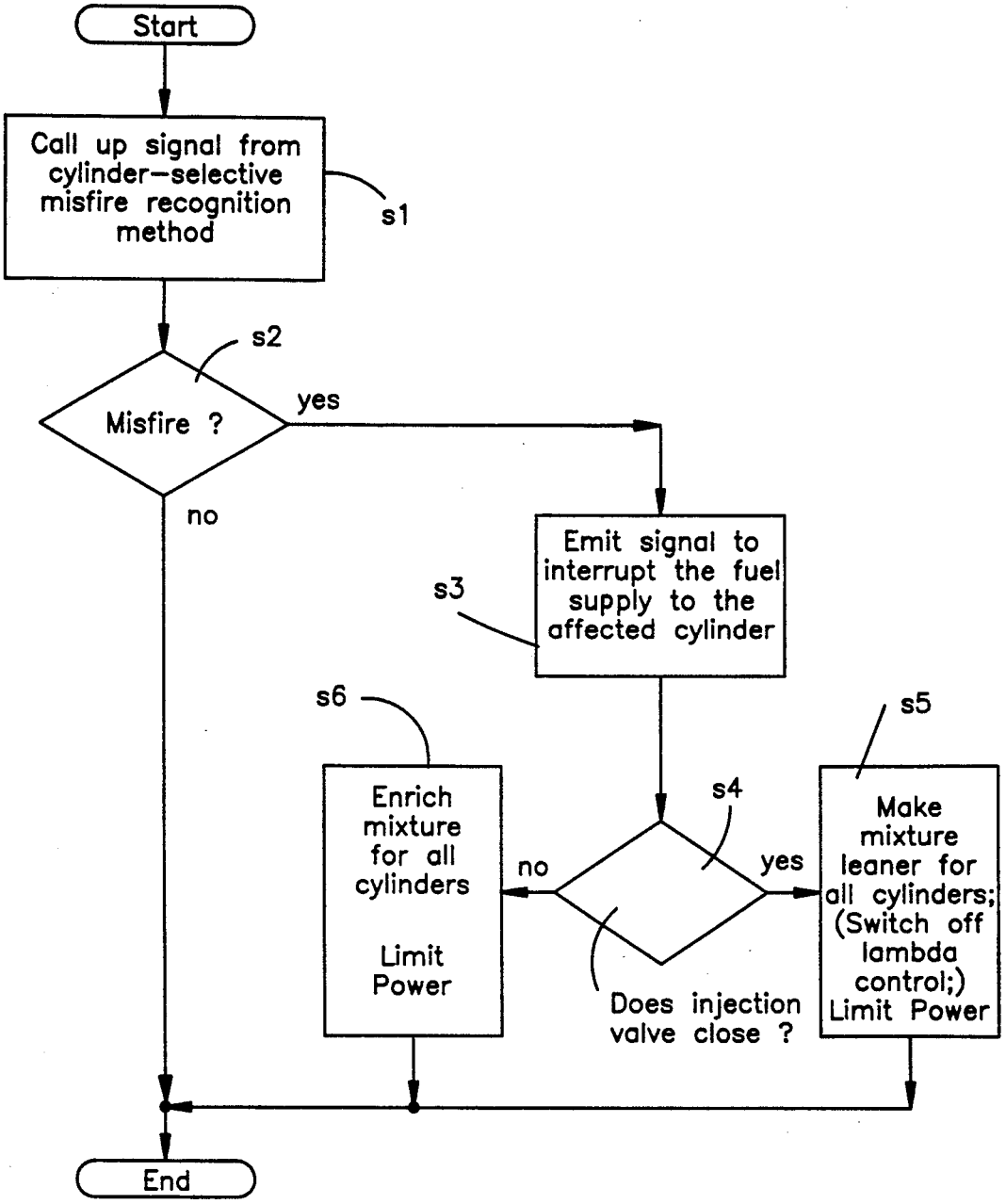
Start
Call up signal from cylinder-selective misfire recognition method
s1
s2
Misfire ?
yes
no
Emit signal to interrupt the fuel supply to the affected cylinder
s3
s6
s5
s4
Enrich mixture for all cylinders
Limit Power
no
yes
Make mixture leaner for all cylinders; (Switch off lambda control;) Limit Power
Does injection valve close ?
End

METHOD FOR PROTECTING A CATALYTIC CONVERTER

FIELD OF THE INVENTION

The invention relates to a method for protecting a catalytic converter from overheating. Overheating can take place when misfires occur in a cylinder. Uncombusted mixture then reaches the catalytic converter and combusts there. The resulting increase in temperature can destroy the catalytic converter and may even set the affected vehicle on fire.

BACKGROUND OF THE INVENTION

Numerous different methods are known for recognizing misfires. Their common purpose is to interrupt the supply of fuel to the affected cylinder. The air induced by this cylinder, however, is then still available for combustion in the catalytic converter. This becomes problematic when the other cylinders are operated with a rich mixture. This condition occurs particularly in the case of lambda control when lean mixture is initially indicated because of the excess air from the affected cylinder. In order to avoid the damaging effect of excess air, it is known from DE-A-23 40 541 to arrange a controllable flap in each induction pipe to the individual cylinders of an engine. If the fuel supply to a cylinder is interrupted, the associated flap is at the same time adjusted in such a way that the cylinder is cut off from the air supply. This protective measure, however, involves a substantial structural complexity.

Another measure for protecting a catalytic converter in the case of interrupted fuel supply to one cylinder consists in substantially reducing the power of the engine. In this case, post-combustion of air from the affected cylinder and fuel from the rich mixture in the other cylinders does not lead to overheating of the catalytic converter. Although this method does not require special structural measures, the substantial reduction in power is disadvantageous.

There is, therefore, the long-standing problem of providing a method for protecting a catalytic converter from overheating in the case of misfires in an engine which requires no special structural measures and which does not lead to a substantial reduction in power.

SUMMARY OF THE INVENTION

The method according to the invention for protecting a catalytic converter from overheating is distinguished in that a conventional method for cylinder-selective misfire recognition is used to determine whether misfires are occurring in a cylinder, and, if this is the case, the fuel supply to the affected cylinder is interrupted and the remaining cylinders are supplied with a lean mixture.

This measure ensures that no excess fuel, but only excess air, can reach the catalytic converter.

Making the mixture leaner in the full-load range can, however, lead to an unallowable increase in the manifold temperature because there is then no cooling by excess fuel. In various types of engines, it is therefore advantageous to limit the engine power in the full-load range. This, however, does not involve the substantial reduction in power necessary in the case of the known methods, which do not ensure a lean mixture. In these latter methods, power limitation to well below full load has to be effected.

In exceptional cases, misfires occur because an injection valve will no longer close and, in consequence, the mixture becomes so over-rich, particularly in the low-load range, that it can no longer be ignited. If, in this case, the injection valve of the affected cylinder is activated by the signal to interrupt the fuel supply, this measure remains ineffective. In this case, the mixture for all the cylinders is enriched so that the only oxygen available for the combustion of the substantial excess fuel from the affected cylinder is that induced by the affected cylinder itself.

BRIEF DESCRIPTION OF THE DRAWINGS

The single FIGURE shows a flow diagram to explain a method for protecting a catalytic converter from overheating.

DESCRIPTION OF THE PREFERRED EMBODIMENTS OF THE INVENTION

In the method shown in the FIGURE, the signal of any given conventional cylinder-selective misfire recognition method is called up in a step s1 after the start of the method. In a step s2 a check is made whether misfires are occurring in a cylinder. If this is not the case, the method is terminated. The method is then repeatedly called up, and this is also the case when the end is reached via another path.

If step s2 indicates that a cylinder is exhibiting misfires, a step s3 attempts to interrupt the supply of fuel to the affected cylinder by continuously providing its injection valve with the signal "close". In a step s4, a conventional diagnostic method for the final stages of the injection valves is used to investigate whether the injection valve subject to the control actually closes. If this is the case, the mixture in the other cylinders is made leaner in a step s5. For this purpose, the lambda control must be switched off, if a condition is not already present in which the operation is carried out by engine control instead of by lambda control. The power is also limited, if necessary, this depending on the particular type of engine. The current run through the method then comes to an end.

The leaner setting preferably takes place on the basis of precontrol values as they are available to fix the injection durations for lambda control or special types of operation, such as full load. These precontrol values are adapted for the the operating range in which lambda control normally occurs in such a way that they lead, as accurately as possible, to a lambda value of one. The precontrol values are multiplied by a factor less than one, for example by a factor 0.9, in order to produce reduced injection durations and hence a leaner mixture. The factor must be somewhat smaller for the values which apply to the full-load range than for values which apply to the lambda control range. This is because, in the full-load range, the precontrol values are not intended to lead to the lambda value one but, rather, to a lambda value for rich mixture.

Power limitation can take place in various ways. In the case of turbocharged engines, it is advantageous to reduce the boost pressure. In engines with electronic power control, that is where the movement of an accelerator pedal is not transmitted to a throttle flap mechanically but by means of electronic actuators, the power limitation is advantageously undertaken by limiting the maximum throttle flap opening angle as a function of the operating point. In all other engines, the power can be limited by limiting the fuel supply by switching off the injection valve of one cylinder or the injection valves of a plurality of cylinders in a specified cycle.

If, in step s4, it is found that the inlet valve of the cylinder with the misfires can no longer be closed, the mixture for all the cylinders is enriched in a step s6 and the lambda control is switched off. This ensures that only the air induced through the cylinder with the misfires is available for the combustion of the excess fuel from this cylinder. The combustion of fuel and oxygen in the catalytic converter cannot, however, be completely avoided in this case. For this reason, the power is limited in any event in order to prevent overheating of the catalytic converter due to the unavoidable post-combustion.

If misfires occur, this is determined by conventional misfire recognition methods, as already explained. These also cause a warning lamp to be lighted and, if appropriate, they cause diagnostic information to be stored. From time to time, it is possible to investigate whether the misfires are still present or whether the fault has been cured. This is described in the already mentioned DE-A-23 40 541. If the fault is no longer present, the selected engine control measures are cancelled, the diagnostic information is erased, and the warning lamp is switched off.

We claim:

1. A method for protecting a catalytic converter from overheating, the method comprising the steps of:

determining whether misfires are occurring in a cylinder;

supplying a signal for interrupting the metering of fuel to the affected cylinder if misfires are occurring in said cylinder; and, if the metering of fuel is interrupted, then switching from a lambda control of the mixture composition over to an open-loop control, said open-loop being configured to achieve a lean mixture for those cylinders which are still operating.

2. The method of claim 1, wherein, if the fuel supply to the affected cylinder cannot be interrupted despite the corresponding interruption signal because of a fault in the injection valve for this cylinder, then the mixture to all the cylinders is enriched and the engine power is limited.

3. The method of claim 1, wherein the engine power is limited.

* * * * *